US005949016A

United States Patent [19]

Baroody et al.

[11] Patent Number: 5,949,016

[45] Date of Patent: Sep. 7, 1999

[54] ENERGETIC MELT CAST EXPLOSIVES

[75] Inventors: Edward E. Baroody, Bryans Road; Carl Gotzmer, Accokeek; Horst G. Adolph, Burtonsville, all of Md.

[73] Assignee: The United States of America as represented by the Secretary of the Navy, Washington, D.C.

[21] Appl. No.: 07/737,522

[22] Filed: Jul. 29, 1991

[51] Int. Cl.[6] ..... C06B 45/10

[52] U.S. Cl. ..... 149/18; 149/19.5; 149/19.9; 149/19.91; 149/88

[58] Field of Search ..... 149/18, 19.5, 88, 149/19.9, 19.91

[56] References Cited

U.S. PATENT DOCUMENTS

| | | | |
|---|---|---|---|
| 3,160,654 | 12/1964 | Conly | 149/88 |
| 3,480,490 | 11/1969 | Finger et al. | 149/88 |
| 3,770,524 | 11/1973 | Walker et al. | 149/19.5 |
| 4,304,614 | 12/1981 | Walker et al. | 149/88 |
| 4,555,277 | 11/1985 | Scribner | 149/88 |
| 4,978,482 | 12/1990 | Johnson et al. | 149/19.9 |
| 5,009,728 | 4/1991 | Chan et al. | 149/19.91 |

*Primary Examiner*—Edward A. Miller

*Attorney, Agent, or Firm*—John Forrest; Roger D. Johnson

[57] ABSTRACT

A melt cast explosive containing bis(2,2-dinitropropyl) fumarate or 2,2-dinitropropyl-4,4-dinitropentanoate and a metal fuel such as aluminum, magnesium, boron, hafnium, zirconium or alloys or mixtures thereof. An inert thermoplastic elastomer diluent may be added to improve the strength of the explosive.

18 Claims, No Drawings

ENERGETIC MELT CAST EXPLOSIVES

BACKGROUND OF THE INVENTION

This invention relates to explosives and more particularly to energetic binder systems for explosives.

Existing explosive melt cast technology is based on an energetic melt cast binder such as 2,4,6-trinitrotoluene (TNT). Examples of TNT based explosives compositions are, TRITONAL (TNT/aluminum), H-6 (TNT/aluminum/RDX), Comp. B (TNT/RDX), and OCTOL (TNT/HMX). They are traditionally processed in large anchor melt cast kettles heated with hot water or steam. In general, the TNT based explosives do not meet the Navy's Insensitive Munitions criteria (fail sympathetic detonation, bullet impact, and cook-off tests). Present DOD attempts to meet both insensitive munitions requirements and performance requirements have fallen short with compositions like AFX-920, AFX-1100, PBXW-122, and PBXN-109.

SUMMARY OF THE INVENTION

Accordingly, an object of this invention is to provide new energetic, melt cast binder systems for explosives.

Another object of this invention is to provide new energetic, melt cast binder systems that produce new explosives that are less sensitive to heat and impact than TNT based explosives but which have comparable energies.

A further object of this invention is to provide energetic, melt castable binder systems which are more energetic than inert binder systems but which still produce explosives with low heat and impact sensitivities.

Yet another object is to provide a new energetic, melt cast binder systems which have a higher oxygen balance than TNT based binder systems.

A still further object of this invention is to provide an energetic, nonsensitive, binder system which can be mixed as a melt at relatively low temperatures with the other components (e.g., Al, RDX, HMX, etc.) of the explosive using inexpensive, conventional, low-shear mixing equipment.

These and other objects of this invention are accomplished by providing:

a melt cast explosive comprising a mixture of

A. an energetic binder compound which is bis(2,2-dinitropropyl)fumarate or 2,2-dinitropropyl-4,4-dinitropentanoate which serves as a binder, an explosive, and an oxidant; and B. a metal fuel.

In addition, an inert thermoplastic elastomer diluent based on a thermoplastic polystyrene-elastomer-polystyrene block copolymer with low viscosity plasticizers added may be used to strengthen the binder.

Other ingredients such as solid oxidants, explosives, etc may be added to the basic composition.

DETAILED DESCRIPTION OF THE PREFERRED EMBODIMENT

This invention comprises new energetic melt cast binder systems based on bis(2,2-dinitropropyl)fumarate (FUM),

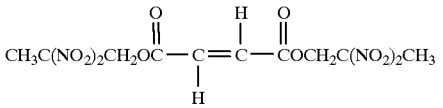

(trans) m.p. 84° C., or 2,2-dinitropropyl-4,4-dinitropentanoate (PENT),

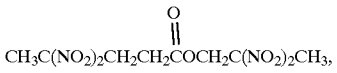

m.p. 95° C.

These compounds can be used alone or in combination with inert melt castable thermoplastic elastomer (TPE) diluents. The TPE diluents are added to improve the physical properties (such as yield strength) of the binders. However, addition of the TPE diluents also reduces the energy densities of the binders and thus the explosives.

The simplest composites of the explosives are the energetic binder material (that is bis(2,2-dinitropropyl)fumarate or 2,2-dinitropropyl-4,4-dinitropentanoate) mixed with a metal fuel of the kind commonly used in explosives. Examples of such metal fuels are aluminum, magnesium, boron, hafnium, zirconium, or alloys or mixtures thereof, with aluminum and magnesium being preferred, and with aluminum being most preferred. These metal fuels are commonly in the form of powders or flakes. The bis(2,2-dinitropropyl)fumarate or the 2,2-dinitropropyl-4,4-dinitropentanoate preferably comprises from about 70 to less than 100 and more preferably from 73 to 85 weight percent of the energetic binder/metal fuel mixture with the metal fuel comprising the remainder. In other words, the metal fuel preferably comprises from 30 to more than zero or more preferably from 27 to 15 weight percent of the energetic binder/metal fuel mixture. In these simple explosive compositions, the bis(2,2-dinitropropyl)fumarate or the 2,2-dinitropropyl-4,4-dinitropentanoate functions as the binder material for the explosive, as the oxidant for the metal fuel, and as an explosive.

In a slightly more complicated explosive composite, an inert TPE diluent is added to the bis(2,2-dinitropropyl)fumarate or to the 2,2-dinitropropyl-4,4-dinitropentanoate to improve the physical properties of the binder. Preferably from more than zero to about 15 and more preferably from 1 to 10 weight percent of inert TPE diluent based on the weight of the bis(2,2-dinitropropyl)fumarate or the 2,2-dinitropropyl-4,4-dinitropentanoate that is added. The bis(2,2-dinitropropyl)fumarate or the 2,2-dinitropropyl-4,4-dinitropentanoate will still preferably comprise from about 70 to less than 100, more preferably from 73 to 85 weight percent of the bis(2,2-dinitropropyl)fumarate/metal fuel mixture or the 2,2-dinitropropyl-4,4-dinitropentanoate/metal fuel mixture.

The inert melt cast thermoplastic elasomer (TPE) diluents are preferably based on ABA type or AB type block copolymers where A represents a polystyrene (hard) block and B represents an elastomeric (soft) block such as polybutadiene, polyisoprene, polyethylenebutylene, polyacrylate, polyether, etc., or mixtures thereof. One or more low viscosity ingredients such as polyterpene, glycerol esters of tall oil rosins, mineral oils, hydrogenate castor oil (process meltable solid), naphthenic oils, paraffinic oils, or olefinic oils are added to the block copolymer to lower its viscosity at the process temperature so that conventional, low-cost, low-shear mixers can be used to prepare the explosive. Table 1 shows 4 examples of suitable thermoplastic diluents for the energetic binders of this invention.

TABLE 1

| BINDER NO. INGREDIENTS | BAR 9 | BAR 28 | BAR 51 | BAR 57 |
|---|---|---|---|---|
| | PERCENT INGREDIENTS | | | |
| STEREON 840A | 15.00 | 20.00 | 12.00 | 15.00 |
| ZONATAC 105 | 64.00 | 17.50 | 52.50 | 0.00 |
| ZONESTER 85 | 00.00 | 0.00 | 0.00 | 54.00 |
| DRAKEOL 10 | 15.00 | 49.50 | 33.00 | 30.00 |
| CENWAX G | 5.00 | 9.50 | 0.00 | 0.00 |
| KEMAMIDE | 0.50 | 3.00 | 2.00 | 0.50 |
| IRGANOX | 0.50 | 0.50 | 0.50 | 0.50 |
| VISCOSITY AT 95° C. | Good | Good | Good | Good |
| FLEXIBILITY AT −20° C. | Fair | Flexible | Flexible | Flexible |

The example compositions are based on STEREON 840A which is a polystyrene-polybutadiene-polystyrene block thermoplastic polymer. Either ZONATAC 105 (a polyterpene) or ZONESTER 85 (a glycerol ester of tall oil rosin) is added to reduce viscosity and improve adhesion between binder, solids, and bomb walls. DRAKEOL 10B is a mineral oil which is used as a plasticizer to reduce viscosity during mixing and casting. Other mineral oils may also be used. CENWAX G is a hydrogenated castor oil which is used to reduce viscosity during mixing and casting and to eliminate growth and exudation of the explosive. Additional conventional ingredients such as antisticking agents (for example, KEMAMIDE E, a fatty acid amide) and antioxidants (for example, IRGANOX 1010, a sterically hindered phenol) may also be added. Additional examples of suitable TPE diluents are given in U.S. Pat. No. 4,978,482, titled "Melt Cast Thermoplastic Elastomeric Plastic Bonded Explosive," which issued to Nancy C. Johnson et al. on Dec. 18, 1990, hereby incorporated in its entirety by reference. The patent discloses binders based on block copolymers ABA wherein A represents a polystyrene block and B represents an elastomeric block that is a polybuadiene, polyisoprene, or polyethylenebutylene. The ABA block copolymer of the patent is mixed with a plasticizer selected from naphthenic, paraffinic, or olefinic oils. Rubber phase associating and polystyrene phase associating hot melt resins may also be added.

Table 2 lists some examples of bis(2,2-dinitropropyl) fumarate (FUM) based and 2,2-dinitropropyl-4,4-dinitropentanoate (PENT) based explosives and some of their properties.

TABLE 2

EXPLOSIVE FORMULATIONS

| FORMULATION INGREDIENTS | ALFUM | ARFUM | ALPENT | ALFUMB |
|---|---|---|---|---|
| | PERCENT INGREDIENTS | | | |
| FUM[1] | 73.00 | 63.00 | 00.00 | 69.35 |
| PENT[2] | 00.00 | 00.00 | 73.00 | 00.00 |
| Al | 27.00 | 27.00 | 27.00 | 25.65 |
| RDX[3] | 00.00 | 10.00 | 00.00 | 00.00 |
| BAR-57 BINDER | 00.00 | 00.00 | 00.00 | 05.00 |
| | PROPERTIES | | | |
| $\Delta H_f$(cal/g) | −438 | −366 | −365 | −454 |
| Density (g/cc)[4] | 1.76 | 1.80 | 1.74 | 1.72 |
| Flame Tem. (Kelvin) | 2788 | 2868 | 2835 | 2728 |
| Moles gas/100 g | 3.25 | 3.24 | 3.41 | 3.23 |

TABLE 2-continued

EXPLOSIVE FORMULATIONS

| FORMULATION INGREDIENTS | ALFUM | ARFUM | ALPENT | ALFUMB |
|---|---|---|---|---|
| HDET[5] (cal/g) | 1775 | 1805 | 1837 | 1668 |
| HDET (cal/cc) | 3143 | 3243 | 3200 | 2874 |

[1] FUM is bis(2,2-dinitropropyl)fumarate
[2] PENT is 2,2-dinitropropyl-4,4-dinitropentanoate
[3] RDX is cyclotrimethylenetrinitramine
[4] Theoretical density
[5] Heat of detonation The ALFUM formulation is an example of a simple explosive based on bis(2,2-dinitropropyl)fumarate and aluminum powder as a metal fuel. Similarly the ALPENT formulation is an example of a simple explosive based on 2,2-dinitropropyl-4,4-dinitropentanoate and aluminum powder. The ALFUMB formulation is an example of an explosive based on binder made of bis(2,2-dinitropropyl)fumarate with a TPE diluent added in an amount that is 7.2 percent of the weight of the bis(2,2-dinitropropyl)fumarate. In the ARFUM formulation, 13.4 weight percent of the bis(2,2-dinitropropyl)fumarate is replaced with RDX. This demonstrates that RDX and bis(2,2-dinitropropyl)fumarate are compatible. Note however that the impact sensitivity data in table 3 shows that this inclusion of RDX increases the impact sensitivity from 261.1 cm 50% height to 70.1 cm 50% height. If RDX is added, preferably from more than zero to about 15 and more preferably from 1 to 10 weight percent of the bis(2,2-dinitropropyl)fumarate will be replaced in RDX.

Table 3 presents impact sensitivity data that demonstrates that the bis(2,2-dinitropropyl)fumarate (FUM) and the 2,2-dinitropropyl-4,4-dinitropropanoate (PENT) explosive compositions without RDX are much less sensitive to impact.

TABLE 3

IMPACT SENSITVITY TEST

| COMPOUND NAME | 50% Ht (cm) |
|---|---|
| RDX 'A' STD X1009 | 18.9 |
| TNT X 862 STD | 87.3 |
| FUM | 276.1 |
| PENT | >320 |
| 27% Al/73% FUM | 261.2 |
| 27% Al/73% PENT | >320 |
| 27% Al/10% RDX/63% FUM | 70.1 |

Impact sensitivity test conditions were as follows: ERL Bruceton apparatus, 25 drops per sample, approximately 35 mg per shot, 2.5 kg drop weight, type 12 tools, Gen Rad noisemeter, and garnet paper 180A.

Table 4 presents safety test data for bis(2,2-dinitropropyl) fumarate.

TABLE 4

SAFETY TEST DATA FOR BIS(2,2-dinitropropyl)fumarate[1]

| Test | Results | Relative sensitivity |
|---|---|---|
| Impact (3 consecutive positive values, 5 kg. wt.) | >600 mm | low |
| Sliding Friction (8 ft./sec., 20 Til)[2] | >980 psig | low |

TABLE 4-continued

SAFETY TEST DATA FOR BIS(2,2-dinitropropyl)fumarate[1]

| Test | Results | Relative sensitivity |
|---|---|---|
| Electrostatic (5000 volts, 20 Til) | >12.5 joules | low |

[1]Safety tests conducted at Naval Ordnance Station, Indian Head, Md.
[2]Threshold Friction Level The explosive compositions of this invention are prepared by mixing the ingredients under low shear (not exceeding 20 kilopoise) at a temperature of preferably 84° C. to about 110° C. and more preferably from 90° C. to 100° C. when the energetic binder compound is bis(2,2-dinitropropyl) fumarate but at a temperature of from 95° C. to about 110° C. and more preferably at a temperature of from more than 95° C. to 100° C. when the energetic binder compound is 2,2-dinitropropyl-4,4-dinitropentanoate. These energetic binder ingredients are molten in these temperature ranges. After mixing, the molten explosive is poured into a mold or projectile and allowed to cool and solidify.

Other ingredients such as explosives, oxidants, etc., may be added to the basic melt cast explosive composite. However, these ingredients must not destroy the advantages of the present melt case explosives. The added ingredients must not raise the viscosity of the melt above the point (about 20 kilopoise) at which conventional, low cost, low shear mixers can process the explosive melt. The added ingredients should not raise the impact sensitivity too much. And the added ingredients must be chemically compatible with the melt cast explosive.

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A melt cast explosive comprising

A. from about 70 to less than 100 weight percent of a melt cast energetic binder compound that is
(1) bis(2,2-dinitropropyl)fumarate or
(2) 2,2-dinitropropyl-4,4-dinitropentanoate; and B. from about 30 to more than zero weight percent of a metal fuel.

2. The melt case explosive of claim 1 wherein the melt cast energetic binder compound comprises from 73 to 85 weight percent of the melt cast explosive and the metal fuel comprises from 27 to 15 weight percent of the melt cast explosive.

3. The melt cast explosive of claim 1 wherein the melt cast energetic binder compound is bis(2,2-dinitropropyl) fumarate.

4. The melt cast explosive of claim 1 wherein the melt cast energetic binder compound is 2,2-dinitropropyl-4,4-dinitropentanoate.

5. The melt cast explosive of claim 1 wherein the metal fuel is aluminum, magnesium, boron, hafnium, zirconium, or alloys or mixtures thereof.

6. The melt cast explosive of claim 5 wherein the metal fuel is aluminum.

7. The melt cast explosive of claim 5 wherein the metal fuel is magnesium.

8. A melt cast explosive comprising:

A. a melt cast energetic binder compound that is
(1) bis(2,2-dinitropropyl)fumarate or
(2) 2,2-dinitropropyl-4,4-dinitropentanoate;

B. A metal fuel; and

C. an inert thermoplastic elasomer diluent which is added to the melt cast energetic binder compound;

wherein the melt cast energetic binder compound comprises from about 70 to less than 100 weight percent of the total weight of the melt cast energetic binder compound plus the metal fuel with the metal fuel comprising the remainder, and wherein the inert thermoplastic elastomer diluent is present in an amount that is from more than zero to 15 weight percent based on the weight of the melt cast energetic binder compound.

9. The melt cast explosive of claim 8 wherein the thermoplastic elastomer diluent is from 1 to 10 weight percent based on the weight of the melt cast energetic binder compound.

10. The melt cast explosive of claim 8 wherein the thermoplastic elasomeric diluent is based on a block copolymer of the form A-B-A wherein A is a polystyrene block and B is an elastomeric block with a low viscosity ingredient added to produce a diluent that is a low viscosity melt at the melt processing temperatures of the explosive.

11. The melt cast explosive of claim 10 wherein the elastomeric block B is polybutadiene, polyisoprene, polyethylenebutylene, polyacrylate, polyether, or mixtures thereof.

12. The melt cast explosive of claim 10 wherein the low viscosity ingredient added to the block copolymer is selected from the group consisting of polyterpenes, glycerol esters of tall oil rosins, mineral oils, hydrogenated castor oil, naphthenic oils, paraffinic oils, olefinic oils, and mixtures thereof.

13. The melt cast explosive of claim 8 wherein the melt cast energetic binder compound comprises from 73 to 85 weight percent of the total weight of the melt cast energetic binder compound plus the metal fuel with the metal fuel comprising the remainder.

14. The melt cast explosive of claim 8 wherein the melt cast energetic binder compound is bis(2,2-dinitropropyl) fumarate.

15. The melt cast explosive of claim 8 wherein the melt cast energetic binder compound is 2,2-dinitropropyl-4,4-dinitropentanoate.

16. The melt cast explosive of claim 8 wherein the metal fuel is aluminum, magnesium, boron, hafnium, zirconium, or alloys or mixtures thereof.

17. The melt cast explosive of claim 16 wherein the metal fuel is aluminum.

18. The melt cast explosive of claim 16 wherein the metal fuel is magnesium.

* * * * *